US006126125A

United States Patent [19]

Dalton

[11] Patent Number: 6,126,125

[45] Date of Patent: Oct. 3, 2000

[54] ELECTRONIC PRICE LABEL MOUNTING DEVICE

[75] Inventor: Gary C. Dalton, Dacula, Ga.

[73] Assignee: NCR Corporation, Dayton, Ohio

[21] Appl. No.: 09/006,417

[22] Filed: Jan. 13, 1998

[51] Int. Cl.[7] ..... A44B 1/18

[52] U.S. Cl. ..... 248/205.2; 248/309.1

[58] Field of Search ..... 248/309.1, 316.1, 248/316.7, 205.2, 444.1, 451, 450, 467, 548; 40/642.02, 649, 651, 661.03; 211/119.003, 86.01

[56] References Cited

U.S. PATENT DOCUMENTS

| | | | |
|---|---|---|---|
| 4,002,886 | 1/1977 | Sundelin | 235/61.7 R |
| 4,500,880 | 2/1985 | Gomersall et al. | 340/825.35 |
| 4,767,093 | 8/1988 | Jones | 248/205.2 X |
| 4,924,363 | 5/1990 | Kornelson | 362/125 |
| 5,044,104 | 9/1991 | Hopperdietzel | 40/649 X |
| 5,172,314 | 12/1992 | Poland et al. | 364/401 |
| 5,272,826 | 12/1993 | Gingras | 40/649 X |
| 5,448,226 | 9/1995 | Failing, Jr. et al. | 340/825.35 |
| 5,553,412 | 9/1996 | Briechle et al. | 40/124.01 |
| 5,791,080 | 8/1998 | Hamano | 40/642.02 |

FOREIGN PATENT DOCUMENTS

WO 93/19448 9/1993 WIPO .

OTHER PUBLICATIONS

HL Display Catalog, (pp. 36–41), 1995.

Fasteners for Retail, 1996 Buyers Guide, (pp. 24, 32–35, 38, 72, and 77).

Fasteners for Retail, 1997 Buyers Guide, (pp. 22, 23, 32, 35–38, 68 and 73).

*Primary Examiner*—Ramon O. Ramirez

*Attorney, Agent, or Firm*—Paul W. Martin; Peter H. Priest

[57] ABSTRACT

A device for mounting an electronic price label (EPL) to a warehouse shelf which minimizes damage to the EPL from collisions and falls. The device includes a rail which contains the EPL, and a coupler for coupling the rail to an underside of the warehouse shelf. The coupler is weak enough to allow the rail to separate from the shelf when the EPL is struck by a vehicle.

25 Claims, 5 Drawing Sheets

ELECTRONIC PRICE LABEL MOUNTING DEVICE

BACKGROUND OF THE INVENTION

The present invention relates to electronic price label (EPL) systems, and more specifically to an EPL mounting device.

EPL systems typically include a plurality of EPLs for displaying prices of merchandise items on shelves. EPL systems typically obtain their prices from the POS server's PLU file. A transaction establishment may contain thousands of EPLs to display the prices of the merchandise items. The EPLs are coupled to a central server from where information about the EPLs is typically maintained in an EPL data file. The EPL data file contains EPL identification information, and EPL merchandise item information.

EPLs typically include plastic housings and liquid crystal displays. In grocery stores, EPLs are typically attached to a rail along the leading edge of the shelves.

EPLs are not readily usable in a wholesale or retail warehouse environment. In those environments, forklifts are used to move products. If EPLs were attached to warehouse shelving in the same manner as grocery store shelving, they would be at risk of being damaged by the forklifts.

Therefore, it would be desirable to provide an EPL mounting device which reduces the risk of damage to EPLs.

SUMMARY OF THE INVENTION

In accordance with the teachings of the present invention, an electronic price label (EPL) mounting device is provided.

The device includes a section of rail which contains the EPL, and a coupler for coupling the rail to an underside of the warehouse shelf which is weak enough to allow the rail to separate from the shelf when the EPL is struck by a vehicle.

The rail attachment device includes a bottom wall, a back wall coupled to the bottom wall, and a top wall coupled to the back wall. The back wall extends beyond the top wall. A planar member couples to the back wall beyond the top wall and at a predetermined angle to the back wall.

The coupler may include a weak adhesive and/or Velcro.

It is accordingly an object of the present invention to provide an EPL mounting device.

It is another object of the present invention to provide an EPL mounting device for use in warehouses.

It is another object of the present invention to provide an EPL mounting device for use in environments in which EPLs are at risk of being damaged from forklifts and other large transport vehicles.

It is another object of the present invention to provide an EPL mounting device which is separable from a shelf upon contact with a large transport vehicle.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
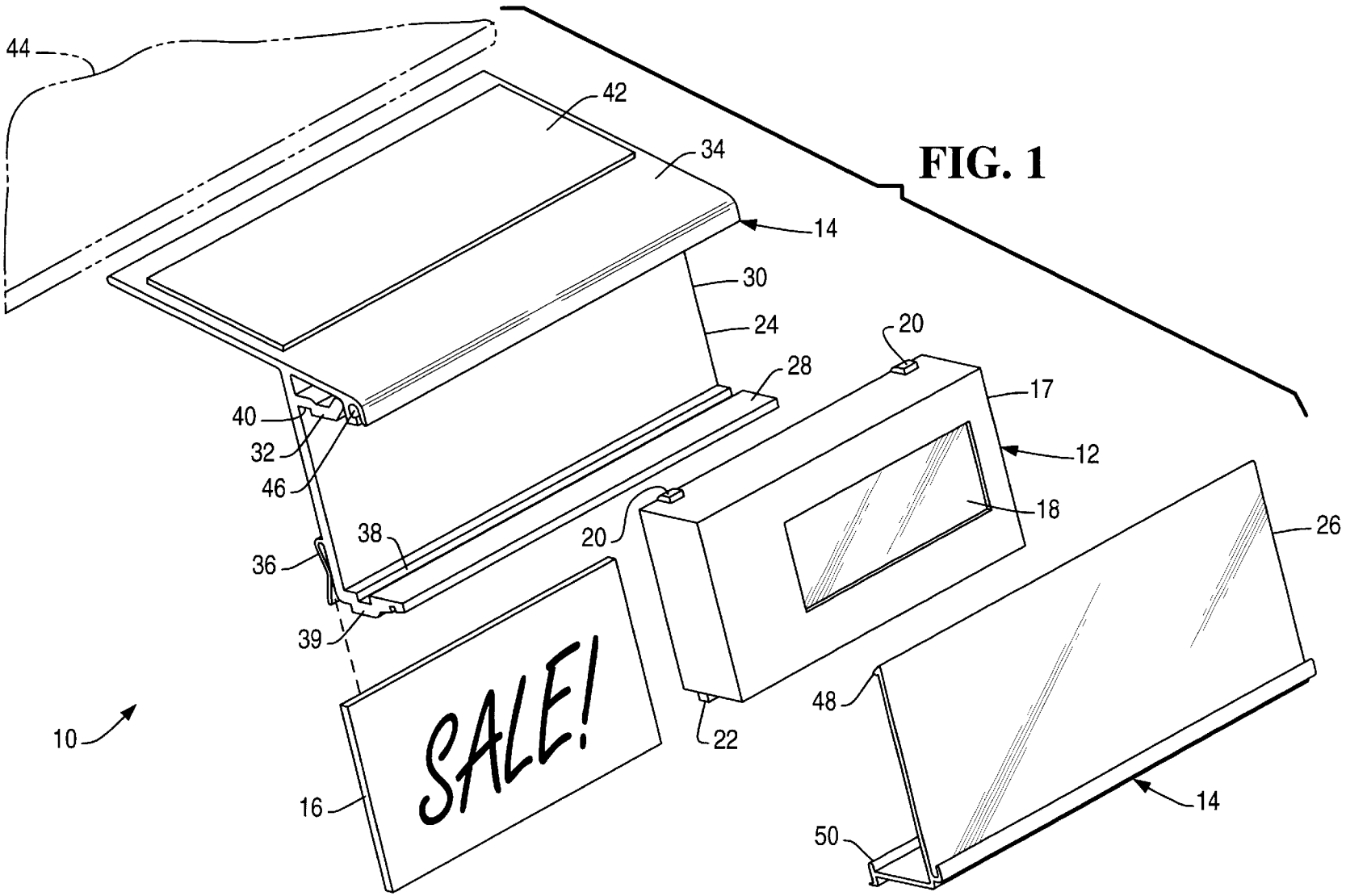
FIG. 1 is an exploded view of an electronic price label (EPL) assembly including a first embodiment of the EPL mounting device.

Referring now to FIG. 1, EPL assembly 10 includes electronic price label (EPL) 12, mounting device 14, and shelf talker 16.

EPL 12 includes housing 17 and display 18.

Housing 17 is substantially box-like in shape and includes pairs of locking tabs 20 and feet 22 for retaining EPL 12 within device 14.

Mounting device 14 includes an EPL containment portion 24 and a protective cover 26.

EPL containment portion 24 acts as a rail for containing one EPL 12. EPL containment portion 24 is preferably made of molded or extruded plastic and includes bottom wall 28, back wall 30, top wall 32, shelf coupler portion 34, and shelf talker retainer 36.

Bottom wall 28 includes channel 38 which retains feet 22 in place within EPL containment portion 24. Bottom wall 28 also includes a sunken wall portion 39 which helps retain protective cover 26.

Top wall 32 includes channel 40 which retains locking tabs 20 in place within EPL containment portion 24.

Back wall 30 joins bottom and top walls 28 and 32.

Shelf coupler portion 34 is substantially flat to attach to the underside of shelf 44. Shelf coupler portion 34 couples at a predetermined angle to back wall 30 and includes retainer 42.

Retainer 42 couples EPL containment portion 24 to the underside of shelf 44. Retainer 42 is preferably strong enough to hold EPL assembly 10 to shelf 44, but weak enough to allow EPL assembly 10 to fall away from shelf 44 when struck.

Figure 2:
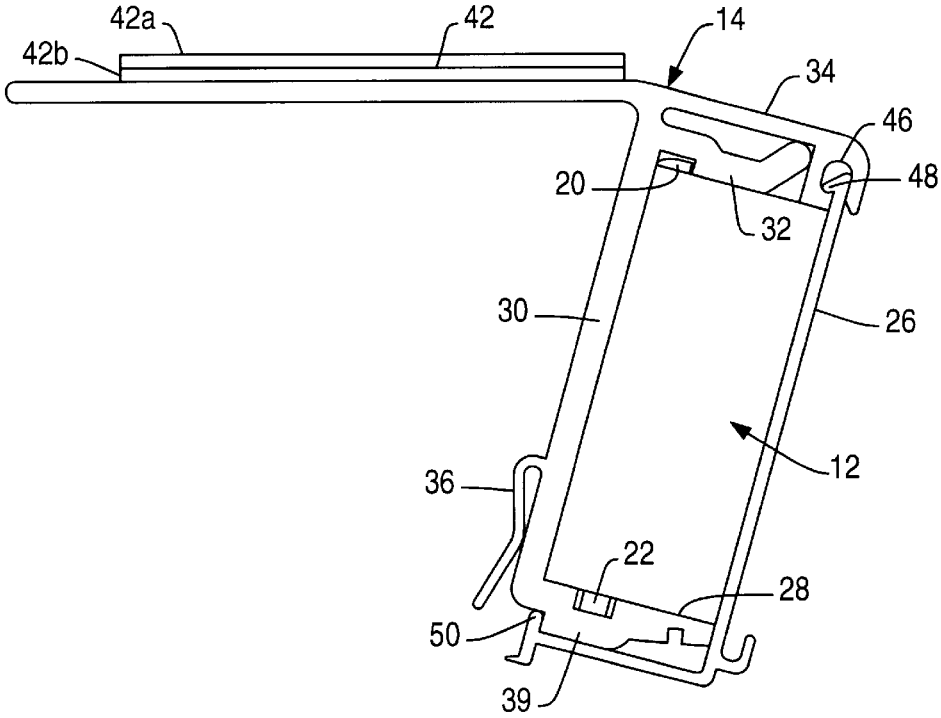
FIG. 2 is a side view of a first embodiment of the EPL mounting device.

Any adhesive suitable for this purpose may be used. However, retainer 42 preferably includes pads of hooks and loops 42*a* and 42*b* (such as Velcro® hook and loop type fasteners) as seen in FIG. 2 with the hook material not attached to a shelf for ease of illustration. For example, a two to four-inch wide strip of 3M Model SJ3552 hook material 42*a* may be attached to the underside of the warehouse shelf 44. A two-inch wide strip of 3M Model SJ3531 loop 42*b* material is attached to EPL containment portion 24. The combination of these two surfaces creates a strong "hook and loop" bond but allows for the attachment device to separate from shelf 44 if an impact occurs.

Shelf coupler portion 34 additionally includes protective cover retainer 46.

Shelf talker retainer 36 applies pressure to the rear surface of back wall 30 in order to securely retain shelf talker 16.

Protective cover 26 protects EPL 12 from damage due to collisions and falls, and is preferably made of transparent plastic. Protective cover 26 includes a tab 48 which is inserted within protective cover retainer 46 and a latch 50 which snaps behind sunken wall portion 39.

Shelf talker 16 conveys promotional information and is preferably made of plastic or paper.

EPL 12 is inserted within EPL containment portion 24 by first inserting feet 22 then locking tabs 20. Locking tabs 20 depress during installation. Protective cover 26 is then installed by inserting tab 48 into protective cover retainer 46 and snapping latch 50 behind sunken wall portion 39. Removal is accomplished in reverse. A key is used to depress locking tabs 20.

Figure 3:
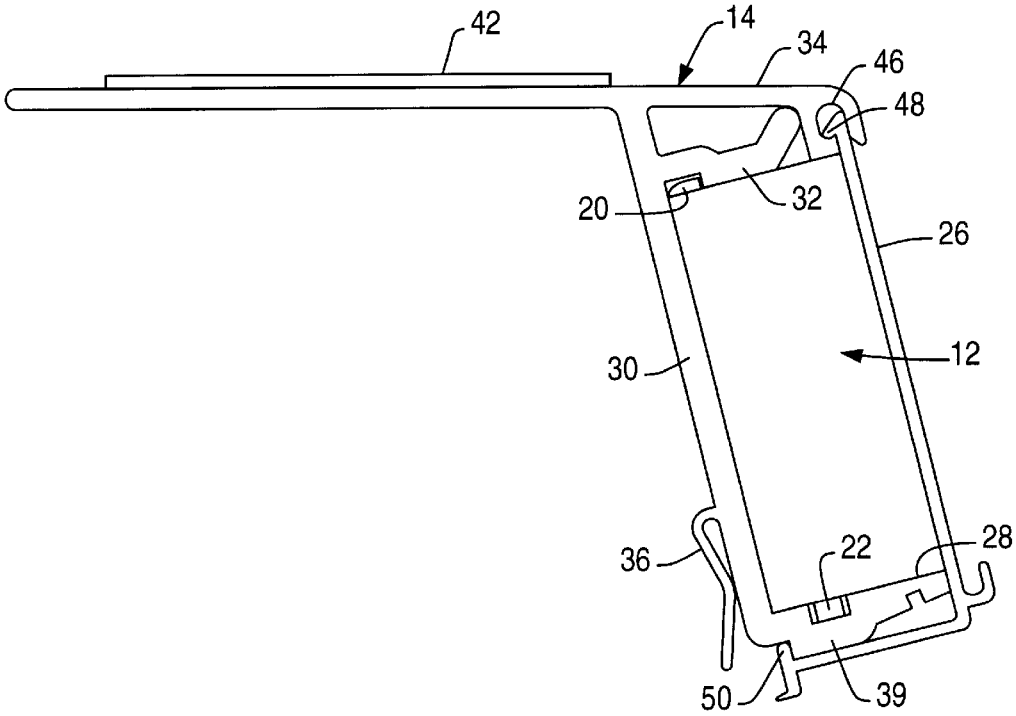
FIG. 3 is a side view of a second embodiment of the EPL mounting device.
Figure 4:
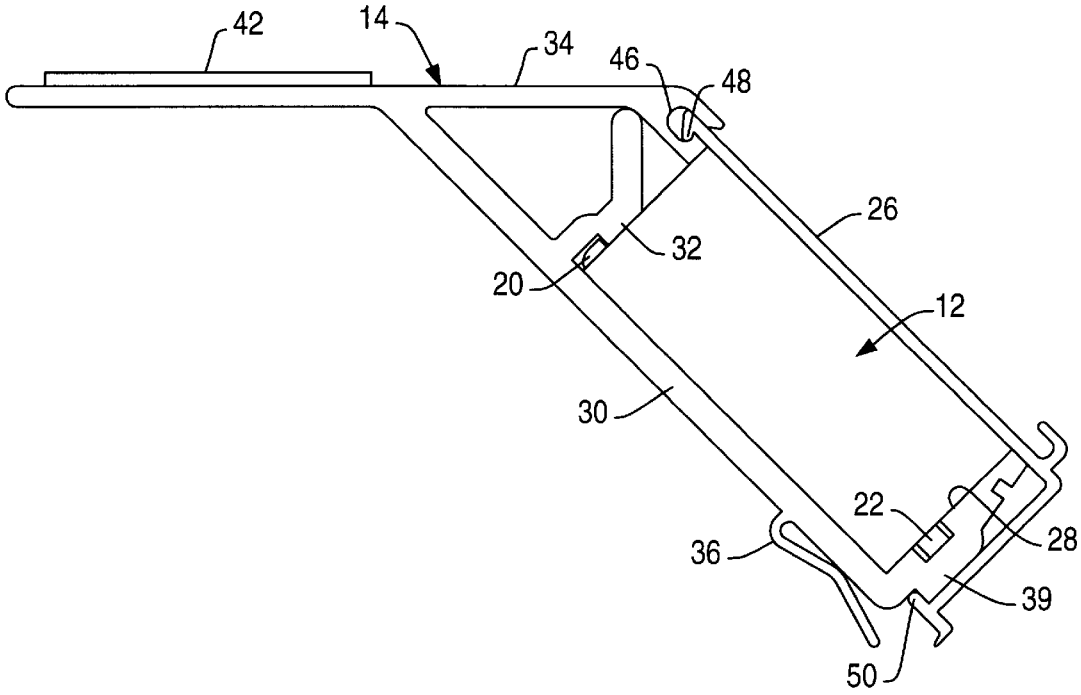
FIG. 4 is a side view of a third embodiment of the EPL mounting device.

Turning now to FIGS. 2–4, three embodiments of EPL containment portion 24 are shown. Each of the three embodiments is intended to accommodate different viewing angles. FIG. 2 discloses an embodiment having a negative five degree angle measured from a normal to shelf 44. This EPL faces downwards and outwards from shelf 44. FIG. 3 discloses a positive five degree angle measured from a normal to shelf 44. FIG. 4 discloses an embodiment having a positive forty degree angle measured from a normal to shelf 44. The latter two EPLs face upwards and outwards from shelf 44.

Figure 5:
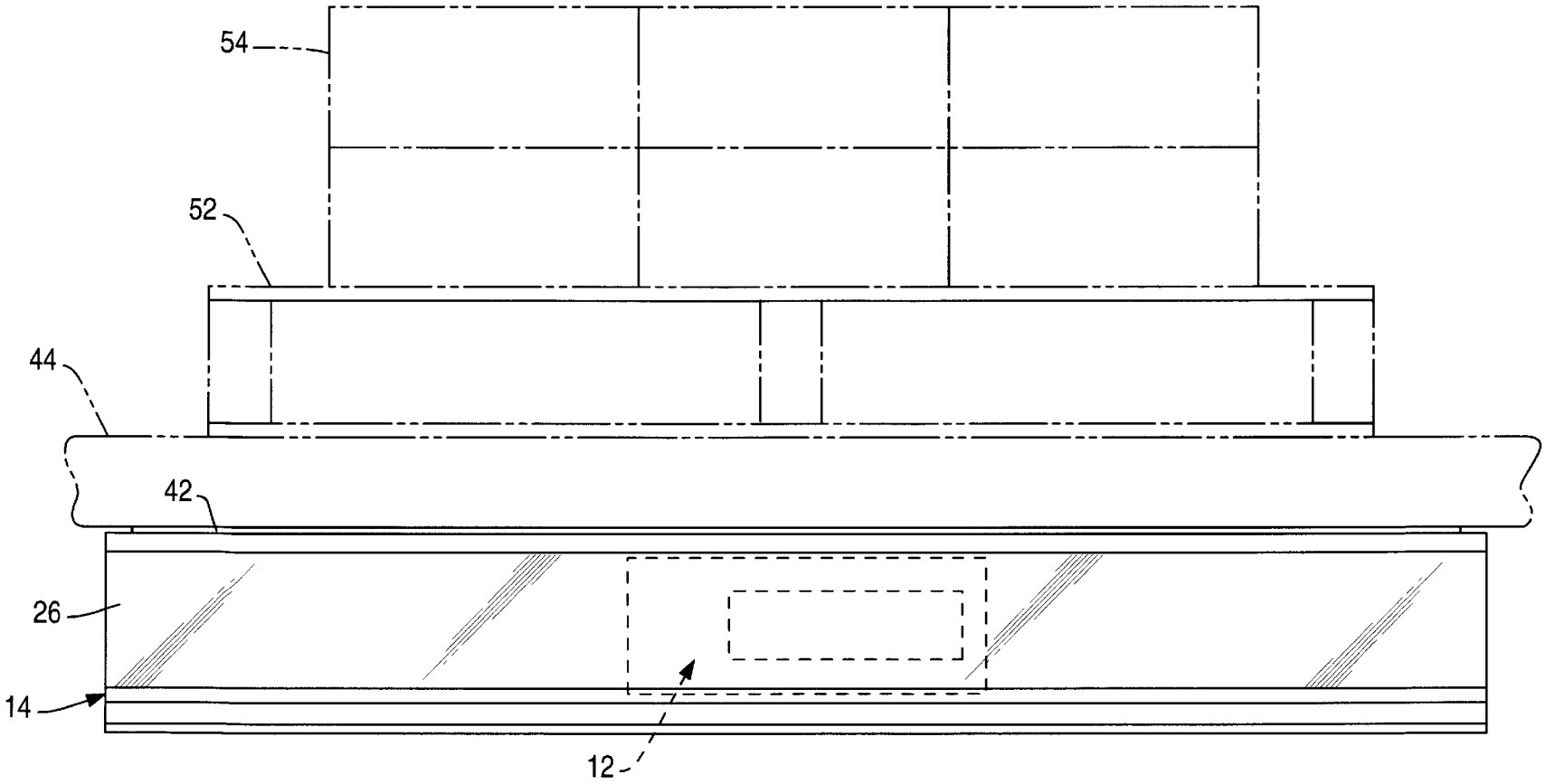
FIG. 5 is a front view of a shelf assembly including the EPL assembly of FIG. 1.
Figure 6:
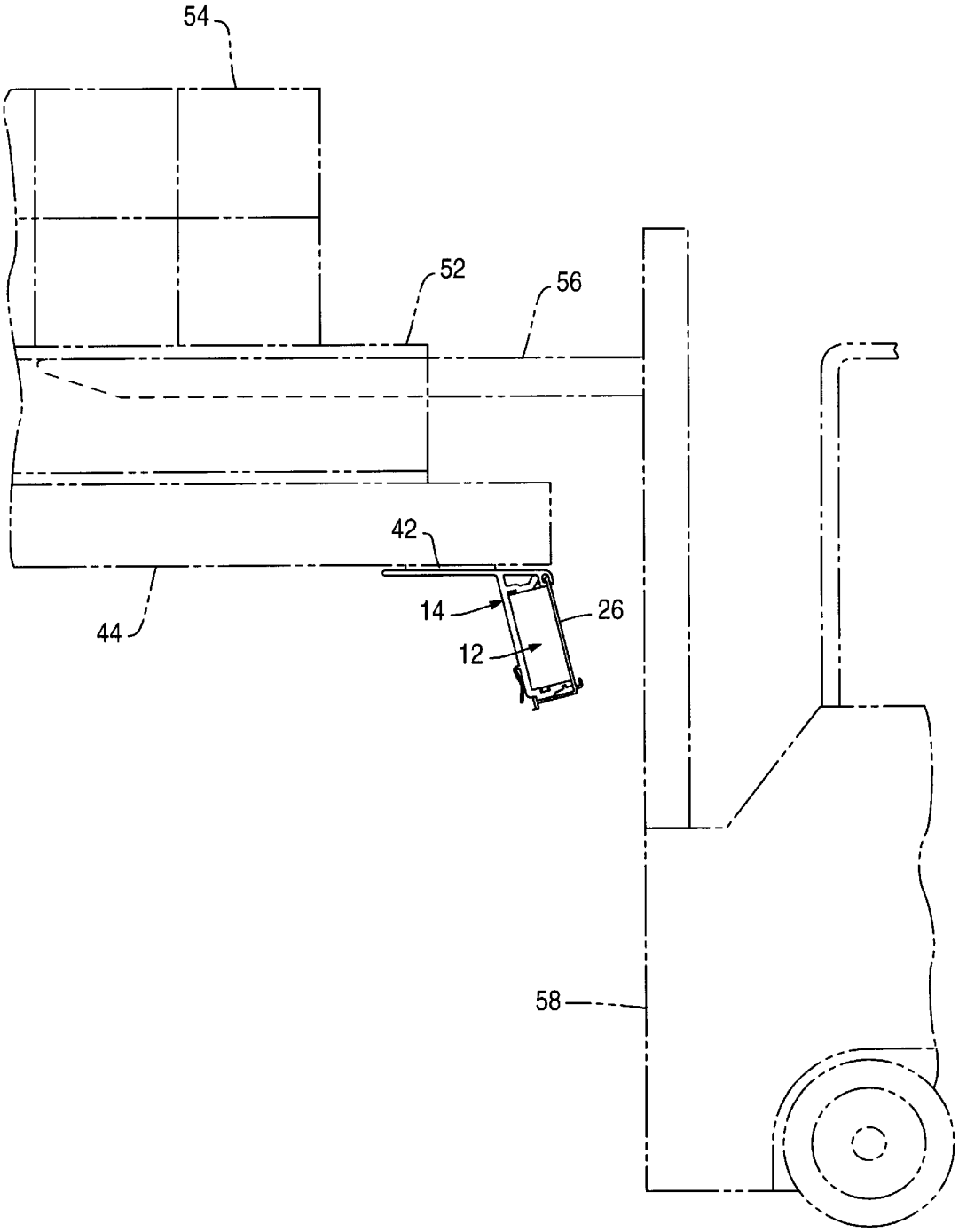
FIG. 6 is a side view of the shelf assembly of FIG. 5.

Turning now to FIGS. 5–6, the embodiment of FIG. 3 is shown mounted along the bottom surface of a warehouse shelf 44. A palette 52 and boxes 54 are located on shelf 44. Mounting device 14 may extend along the length of shelf 44, or extend only long enough to contain EPL 12.

Mounting device 14 of the present invention protects EPL 12 from damage due to collisions with fork lift 58 or its fork members 56. It is a feature of the present invention that mounting device 14 detaches from shelf 44 upon impact to prevent damage to EPL 12.

Although the present invention has been described with particular reference to certain preferred embodiments thereof, variations and modifications of the present invention can be effected within the spirit and scope of the following claims.

We claim:

1. A device for mounting an electronic price label (EPL) to an underside of a shelf comprising:

a rail adapted for protectively containing the EPL in a fixed position; and a shelf coupler having a substantially flat portion and a retainer on top of the substantially flat portion, said retainer for providing the sole attachment to the shelf and adapted to be strong enough to hold said device to the underside of the shelf and for coupling the rail to the underside of the shelf, but weak enough so that the coupler protects the EPL from damage by allowing the rail to separate from the shelf when the rail is struck.

2. The device of claim 1 wherein the rail includes a box-like housing for containing the EPL, the box-like housing adapted to protect the EPL from damage when the rail is struck.

3. The device of claim 1 wherein the rail is adapted to protect the EPL from damage when the rail separates from the shelf and falls.

4. The device of claim 1 wherein the rail includes a clear protective cover adapted to protect the EPL from damage when the rail is struck by a force.

5. An electronic price label (EPL) system for mounting to an underside of a shelf comprising:

an EPL;

a rail protectively containing the EPL in a fixed position; and a coupler having a substantially flat portion and a retainer on top of the substantially flat portion, said retainer adapted to be strong enough to hold said system to the underside of the shelf and for coupling the rail to the underside of the shelf, but weak enough so that the coupler protects the EPL from damage by allowing the rail to separate from the shelf when the rail is struck.

6. The system of claim 5 wherein the retainer comprises a hook and loop type fastener.

7. The system of claim 5 further comprising a shelf talker retainer mounted at the back and bottom of said rail so as not to interfere with a protective cover.

8. The system of claim 7 further comprising a shelf talker attached to the shelf talker retainer.

9. The system of claim 5 wherein the EPL faces generally upwards.

10. The system of claim 5 wherein the EPL faces generally outwards.

11. The system of claim 5 wherein the EPL faces generally downwards.

12. The device of claim 5 wherein the rail includes a box-like housing containing the EPL, the box-like housing adapted to protect the EPL from damage when the rail is struck.

13. The device of claim 5 wherein the rail is adapted to protect the EPL from damage when the rail separates from the shelf and falls.

14. A device for coupling an electronic price label (EPL) to a shelf comprising:

a rail adapted for containing the EPL in a fixed position, the rail comprising:

a bottom wall;

a back wall coupled to the bottom wall;

a top wall coupled to the back wall; and a shelf coupler coupled to the back wall;

a retainer for coupling the shelf coupler to an underside of the shelf, wherein the coupler protects the EPL from damage by allowing the rail to separate from the shelf when the rail is struck.

15. The device of claim 14 wherein the retainer comprises a hook and loop type fastener.

16. The device of claim 14 further comprising a shelf talker retainer.

17. The device of claim 16 further comprising a shelf talker attached to the shelf retainer.

18. The device of claim 14 wherein the rail is adapted for coupling to an underside of a shelf adjacent to a merchandise item.

19. The device of claim 14 further comprising a clear protective cover attached to the rail.

20. The device of claim 14 wherein the rail is composed of extruded plastic.

21. The device of claim 14 wherein the shelf coupler extends past the top wall.

22. An electronic price label (EPL) system comprising:

an EPL;

a rail for containing the EPL in a fixed position, the rail comprising:

a bottom wall;

a back wall coupled to the bottom wall;

a top wall coupled to the back wall; and a shelf coupler coupled to the back wall;

a retainer for coupling the shelf coupler to an underside of the shelf, wherein the retainer protects the EPL from damage by allowing the rail to separate from the shelf when the rail is struck.

23. The system of claim 22 wherein the EPL further comprises a pair of locking tabs and a pair of feet.

24. The system of claim 22 wherein the bottom wall includes a first channel containing a pair of feet and the top wall includes a second channel containing a pair of locking tabs.

25. The device of claim 22 further comprising a clear protective cover attached to the rail, wherein the cover protects the EPL from damage when the rail is struck.

* * * * *